United States Patent [19]

Schuegraf

[11] 4,270,107

[45] May 26, 1981

[54] RECTANGULAR WAVEGUIDE ELBOW FORMED WITH A TRUNCATED CORNER AND HAVING PIPES FORMED THEREIN

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 78,189

[22] Filed: Sep. 24, 1979

[30] Foreign Application Priority Data

Sep. 29, 1978 [DE] Fed. Rep. of Germany ..... 2842577

[51] Int. Cl.[3] ..... H01P 1/02; H01P 5/02

[52] U.S. Cl. ..... 333/249; 333/33; 333/251

[58] Field of Search ..... 333/249, 251, 33, 248, 333/239, 24 R, 27

[56] References Cited

U.S. PATENT DOCUMENTS 2,737,634 3/1956 Lewin et al. ..... 333/249

OTHER PUBLICATIONS

Meinke et al.-"Taschenbuch der Hochfrequenztechnik" Springer-Verlag, Berlin, 1962; pp. 401-403.

*Primary Examiner*—Marvin L. Nussbaum

*Attorney, Agent, or Firm*—Hill, Van Santen, Steadman, Chiara & Simpson

[57] ABSTRACT

A rectangular waveguide elbow formed with a truncated beveled corner on its outer edge and formed with a conductive cross bar which extends between the narrow walls of the waveguide and which is positioned midway between the inner corner of the waveguide elbow and the center of the truncated wall and further including an extending electrically conducting cylinder mounted on the interior surface of the truncated wall with its center on the diagonal of the truncated wall. The diameters of the conductive cross member and of the conductive metal cylinder are chosen so as to minimize the reflection factor and thus to reduce the reflection factor over a relatively broad-band.

3 Claims, 4 Drawing Figures

RECTANGULAR WAVEGUIDE ELBOW FORMED WITH A TRUNCATED CORNER AND HAVING PIPES FORMED THEREIN

BACKGROUND OF THE INVENTION

1. Field of the Invention

This invention relates in general to rectangular waveguide elbows wherein the wide wall of the waveguide is bent at an angle and the outside corner is beveled to form a conductive level plane.

2. Description of the Prior Art

Rectangular waveguide elbows (E-elbows) are disclosed in the publication "Taschenbuch der Hochfrequenztechnik", by H. Meinke and F. W. Gundlach, Springer Verlag, 2nd Edition, 1962 at pages 401 and 402 wherein various microwave circuits with waveguides are illustrated. Relative to comparable low reflection circular arc bends, a compact construction can be achieved with elbow waveguides which are used particularly for waveguide diplexers of different types such as, for example, frequency-diplexers, polarization diplexers, wave mode diplexers and so forth. In constructing such devices, the waveguides with rectangular cross-section having a ratio of the long and narrow sides of a:b-2:1 are most often employed. Such waveguides are usable with the $TE_{10}$-wave in the relative frequency range of the maximum width $f_o:f_u=2:1$. The publication "Taschenbuch der Hochfrequenztechnik" cited above discloses that the reflection of an E-elbow can be reduced by truncating or flattening the outer corner of the elbow.

SUMMARY OF THE INVENTION

The present invention comprises an improvement on a rectangular waveguide E-elbow which is bent across the wide wall of the waveguide and which has its outside corner symmetrically beveled with a conductive sheet and which incorporates an electrical conductive cylindrical bar that extends between the narrow sides of the waveguide with its center being on the center of a line joining the inside corner of the bend of the elbow and the center of the conducting truncated plane and having a diameter for providing minimum reflection coefficient. In addition, a conductive cylinder is mounted on the conducting truncating plane with its center at the crossing point of diagonals of such truncating plane and the diameter of this cylinder is selected to have a predetermined insertion depth and a diameter which has a predetermined relationship to the height of the waveguide.

Other objects, features and advantages of the invention will be readily apparent from the following description of certain preferred embodiments thereof, taken in conjunction with the accompanying drawings although variations and modifications may be effected without departing from the spirit and scope of the novel concepts of the disclosure and in which:

BRIEF DESCRIPTION OF THE DRAWINGS

FIG. 1*b* comprises a plot of the standing wave factors of E-elbows having different ratios x/z of the corner smoothing truncating wall;

DESCRIPTION OF THE PREFERRED EMBODIMENTS

Figure 1A:
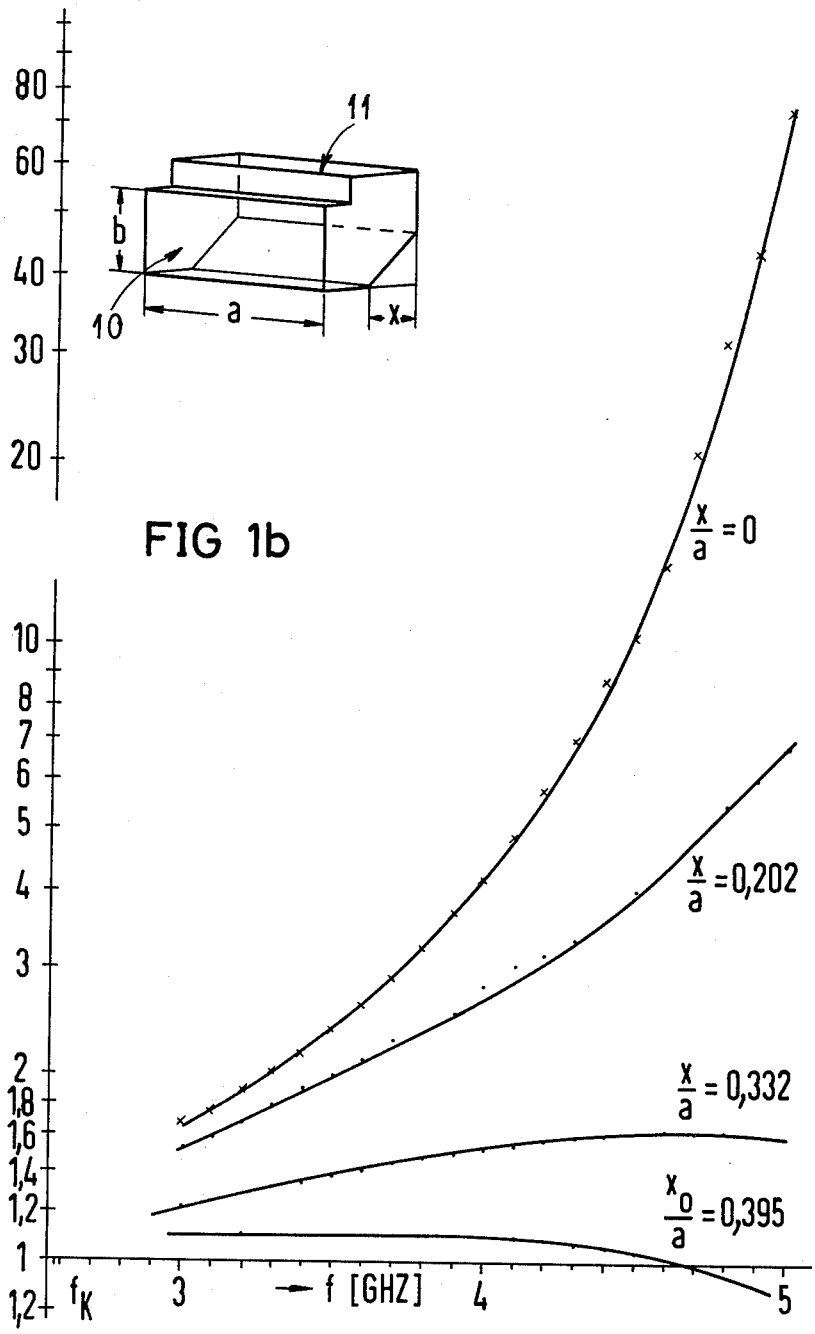
FIG. 1*a* is a prior art waveguide E-elbow with a truncated corner.

FIG. 1*a* illustrates a prior art device such as disclosed in the publication "Taschenbuch der Hochfrequenztechnik" in which the reflection of the E-elbow can be reduced by truncating or flattening the outside corner of the elbow as shown in FIG. 1*a*. FIG. 1*b* comprises a plot of the standing wave ratios of E-elbows such as illustrated in FIG. 1*a* having truncated corners of various degrees and it is to be noted there is an optimum cathetus dimension $x_o$ which comprises the lowest curve in FIG. 1*b* wherein $x_o/a=0.395$ wherein a is the width of the wide wall of the waveguide, b is the height of the narrow walls of the waveguide and x is the dimension from the untruncated corner to the point where the symmetrical truncation between waveguides 10 and 11 extends as illustrated in FIG. 1*a*. Where the ratio as shown by the lowest curve for $x_o/a=0.395$ which can be derived from the referenced handbook, the reflection of an E-elbow will remain below r=5% in the frequency range of a waveguide conventionally employed such as $1.25f_{kTE1O}$ through $1.9f_{kTE1O}$. Smaller reflections can be achieved only in small portions of the frequency bands of this range and for this purpose the cathetus dimension x is changed relative to the value for $x_o$ depending on the height of the partial band within the full waveguide range.

FIG. 1*b* comprises a plot of the standing wave ratio s of E-elbows for waveguides having different selected values of x/a of the corner flattening for E-elbows having a bending angle of 90° and with the ratio of the sides of the rectangular waveguide being equal to a:b=2:1. With no corner smoothing or flattening where the ratio is x/a−0 an E-elbow respresents an inductive interference with respect to a cross-section plane lying at the middle of the bend and the inductive interference rises substantially in the frequency range of a rectangular waveguide. With increasing corners smoothing or flattening, in other words, where the quotients x/a increases, the inductive interference is reduced as the ratio increases. For a corner flattening embodiment wherein $x_o/a=0.395$ for which the interference caused by reflection of r=5% which is the identical size for the upper and lower limits of the waveguide frequency range and the reflections have phase angles which are opposite to one another at the upper and lower frequency range limits. Thus, the reflections will not fall below this value by using the prior art compensation method. The reflections which are still significantly disruptive in many uses which are present in the prior art devices is caused by the fact that the compensation measure of flattening the corner by itself does not provide over the entire frequency range of a rectangular waveguide enough compensation which is complementary to the reflection which is to be compensated.

The present invention provides a specific form of an E-elbow which is modified so as to further reduce the reflection factor over a relatively broad frequency band.

Figure 2:
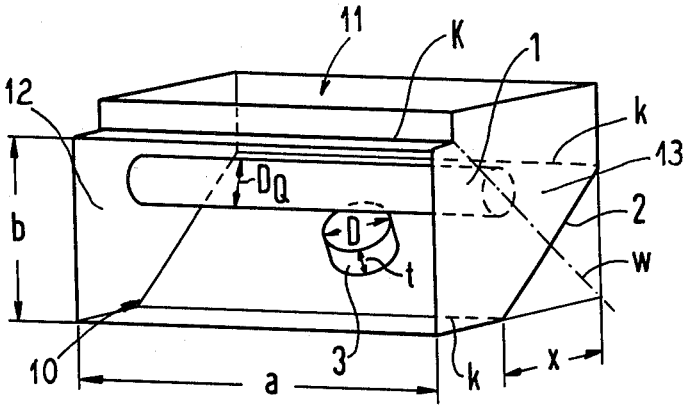
FIG. 2 illustrates the E-elbow of the invention.

FIG. 2 illustrates the E-elbow where two waveguides 10 and 11 meet and which is formed with a truncating electrically conducting planar surface 2 which is symmetrical relative to the outer corner of the elbow and which further includes a cylindrical shape electrically conductive cross bar 1 which extends parallel to the wide walls of the waveguides 10 and 11 and is attached to the narrow walls 12 and 13 of the waveguide. The ends of the electrically conductive cross member 1 are attached to the narrow side walls 12 and 13 such that the center of the cylindrical member 1 lies on a line which passes from the inside corner K to the mid-point of the planar member 2 as defined by the dash dot line w. The center of the cylindrical member 1 is positioned relative to the corner K and the planar member so that it is half-way between.

In the invention, using E-elbows which the corner has been tapered by a plane 2 with values from $0<(x/a)<0.395$ and in particular a preferred value for the quotient of x/a which allows by means of additional easily realizable compensation for the E-elbow to be pre-compensated by a corner tapering and the device can be designed for a broad-band use and so as to be significantly lower in reflection with respect to residual ripples then E-elbow using the prior art corner tapering only with a dimension of $x_o/a=0.395$.

It is particularly advantageous in the present invention to utilize a metal electrically conducting cylinder as the conductive means as the member 1 and by so doing broadband can be accomplished with a low reflection factor.

FIG. 2 illustrates a sample embodiment of the invention which is bent across the wide side a of the waveguide to form an E-elbow and at an angle of bend of $\alpha=90°$ and in which the ratio of the sides of the waveguide is equal to a:b=2:1 and wherein the flattening is caused by a conductive planar member 2 which is symmetrical and in which the cathetus dimension x ratio to the wide side a of the waveguide has a value of $x/a=0.332$. In the invention, the pre-compensated E-elbow addtionally has an electrically conductive cylindrical cross-member 1 which is mounted on the median lines w which extends from the corner K of the inside corner of the elbow to the center line of the symmetrical planar member 2. The cross-member 1 is aligned parallel to the wide sides of the waveguides and extends between the narrow sides which are opposite to each other and are designated by 12 and 13 in FIG. 2. The center axis of the cylindrical member 1 is at a point which divides the median line w into two equal parts such that the cylindrical member 1 is centered between the corner K and the symmetrical conductive planar member 2. The diameter of the member 1 defined as $D_Q$ is selected to have a value of $D_Q/b=0.275$ wherein b is the height of the narrow sides 12 and 13 of the waveguide as illustrated in FIG. 2.

So as to provide additional compensation, a metal cylindrical member 3 is attached to the center of the conducting planar member 2 with the center of the cylinder 3 being at the point of intersection of diagonals of the planar member 2. The metal cylindrical member 3 projects into the interior space of the waveguide as shown. The height of the cylindrical member 3 from the surface 2 to its upper point defined as t is selected so that the ratios t/b is equal to 0.0895. The diameter D of the cylinder 3 is selected so that the ratio $D/b=0.344$.

The two additional compensation means comprising the cylindrical members 1 and 3 have a capacitive effect with different frequency response. Thus, the field distortion in the area of the E-elbow the members 1 and 3 exactly supply the frequency response of the capacitive compensation which matches over a broad-band the inductive interference of the pre-compensated E-elbow illustrated in FIG. 1*b* for a value of $x/a=0.332$.

Figure 3:
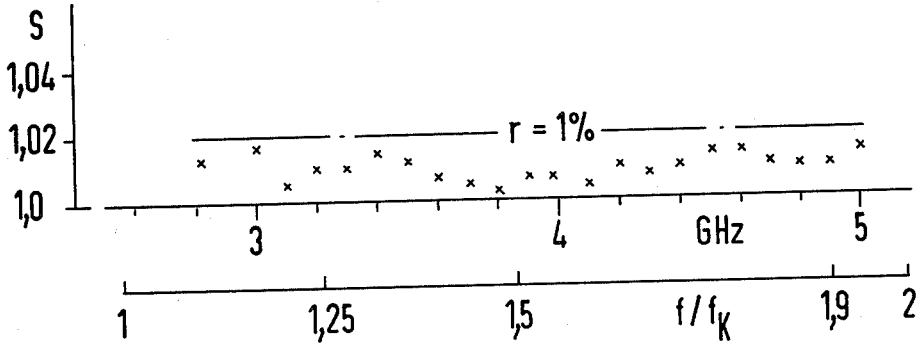
FIG. 3 is a plot of the standing wave verses frequency of the waveguide elbow illustrated in FIG. 2.

FIG. 3 is a curve of a standing wave ratio s plotted as a function of frequency.

As shown in FIG. 3, the E-elbow according to the invention which is triply compensated has a reflection factor in the frequency range of $1.1\ f_{kTE10} \leqq f \leqq 1.95 f_{kTE10}$ and as shown clearly lies below 1%. Thus, by adding the members 1 and 3 allows an E-elbow which is compensated only by means of the corner tapering or flattening wherein $x_o/a=0.395$ can be improved relative to the reflection factor by at least a factor of 5 by the additon of the two simple compensation means 1 and 3.

Although the invention has been described with respect to preferred embodiments, it is not to be so limited as changes and modifications can be made which are within the full intended scope as defined by the appended claims.

I claim as my invention:

1. A rectangular waveguide E-elbow with wide and narrow sides in which the wide side of the waveguide is bent to form an outside corner which is symmetrically beveled to form a conductive level plane (2) comprising, an electrically conductive cross bar (1) mounted in said waveguide at the median of the geometrical angle of the bend, said cross bar aligned parallel to the wide sides of said waveguide and extending between the opposite narrow sides of said waveguide; and a second conductive means (3) mounted at the diagonal point of intersection of said level plane (2) and projecting into the inner space of said waveguide.

2. A rectangular waveguide E-elbow bent across the wide side of the waveguide according to claim 1, characterized in that said second conductive means (3) is a metal cylinder.

3. A rectangular waveguide E-elbow bent across the wide side of the waveguide according to claim 2, characterized in that the bend angle is about 90° and a ratio of the wide to narrow sides is about a:b=2:1, the ratio x/a where x is the truncated distance to the edges (k) from the theoretical altitude of the outside bend edge of the non-beveled elbow and a is the width of the wide side of the waveguide is selected to be at least approximately 0.332; and said conductive cross bar (1) is mounted at a height about midway between the inner bend (K) of the waveguide and the level plane (2); and the diameter $D_Q$ of the cross bar (1) is selected to be in the range of $D_Q/b=0.275$ where b is the width of the narrow side b of the waveguide; and the ratio of the diameter D of the metal cylinder (3) to the width of the narrow side b of the waveguide is selected to be in the region of $D/b=0.344$; and the ratio of the insertion height t of the metal cylinder (3) to the width of the narrow side b of the waveguide is selected to be in the region of $t/b=0.0895$.

* * * * *